US006470787B1

(12) United States Patent
Hirano

(10) Patent No.: US 6,470,787 B1
(45) Date of Patent: Oct. 29, 2002

(54) STROKE ADJUSTABLE FLUID PRESSURE CYLINDER

(75) Inventor: Akihiro Hirano, Ibaraki (JP)

(73) Assignee: SMC Corporation, Tokyo (JP)

( * ) Notice: Subject to any disclaimer, the term of this patent is extended or adjusted under 35 U.S.C. 154(b) by 26 days.

(21) Appl. No.: 09/688,357

(22) Filed: Oct. 16, 2000

(30) Foreign Application Priority Data

Nov. 2, 1999 (JP) ..... 11-312691

(51) Int. Cl.[7] ..... F01B 31/14
(52) U.S. Cl. ..... 92/13.6; 92/85 R
(58) Field of Search ..... 92/13.6, 85 R

(56) References Cited

U.S. PATENT DOCUMENTS 4,211,150 A * 7/1980 Framberg ..... 92/85 R
5,746,110 A * 5/1998 Stoll ..... 92/13.6

* cited by examiner

*Primary Examiner*—Edward K. Look
*Assistant Examiner*—Thomas E. Lazo
(74) *Attorney, Agent, or Firm*—Oblon, Spivak, McClelland, Maier & Neustadt, P.C.

(57) ABSTRACT

A fluid pressure cylinder includes a piston, which is slidably accommodated within a cylinder tube, a hollow piston rod, which is coupled to the above piston, a stopper rod, of which base end is attached to the above head cover so that the location thereof can be adjusted and of which front end is elongated toward within the cylinder tube and passing through a central hole of the above piston and being fitted within the hollow portion of the piston rod and a stopper portion, which is attached to a front end of the above stopper rod and is engaged from the inside of the piston rod to an engaging portion around the above central hole of the above piston at a forwarding stroke end of the above piston.

6 Claims, 3 Drawing Sheets

STROKE ADJUSTABLE FLUID PRESSURE CYLINDER

TECHNICAL FIELD

The present invention relates to a fluid pressure cylinder, in which a stroke of a piston is adjustable.

PRIOR ART

In order to drive workpieces by using a fluid pressure cylinder in the case that there are plural kinds of workpieces and different contents of operations, the fluid pressure cylinder needs to correspond to various workpieces and operational contents. Therefore, plural kinds of fluid pressure cylinders having various strokes of pistons are required.

However, preparing plural kinds of fluid pressure cylinders having different strokes of pistons corresponding to the kinds of the workpieces suffers from a problem that cost for installation of equipment is raised, since the number of the kinds of the fluid pressure cylinder increase.

FIG. 4 shows an example of a known fluid pressure cylinder, by which the above problem can be solved. This fluid pressure cylinder 1 comprises a cylinder tube 3, rod covers 5 and 6, a piston 7 and a rod 8. The rod covers 5 and 6 are displaced on the opposite ends of the cylinder tube 3, which is airtight, in the axial direction by a tie rod 4. The piston 7 slidably moves within the above cylinder tube 3 which is airtight. The rod 8 is coupled with this piston 7 and the opposite ends of the rod 8 pass through the rod covers 5 and 6 in airtight to stick out to the outside of the cylinder 1.

A male thread 8*a* is formed at a front end of the piston rod 8, which sticks out from one rod cover 5 to the outside of the cylinder 1. A stopper 9 for adjusting a stroke of the piston 7 is screwed by the male thread 8*a* so as to move backward and forward in the moving direction of the piston 7. A locking nut 10 fixes the position of the male thread 8*a*.

In this fluid pressure cylinder 1, supplying the compressed air to one cylinder chamber 11A, which is partitioned by the piston 7, the piston 7 and the piston rod 8 moves left in FIG. 4. When the stopper 9 screwed into the piston rod 8 abuts against the rod cover 5, the left moving of the piston 7 and the piston rod 8 are stopped.

Accordingly, a stroke S of the piston 7 can be adjusted depending on moving the fixing position of the stopper 9 Backward and forward to the piston rod 8 by changing the screwed position of the stopper 9.

However, in the fluid pressure cylinder 1, the front end of the above piston rod 8 sticks out to the outside of the cylinder 1 and the stopper 9 is attached to the stuck out portion. Therefore, there is a problem that the length in the axial direction of the fluid pressure cylinder 1 is increased and a large setting space is required.

DISCLOSURE OF THE INVENTION

The present invention has been made taking the foregoing problems into consideration, an object of which is to provide a compact fluid pressure cylinder with a simple structure, which can adjust a stroke of a piston.

In order to solve above described problem, the fluid pressure cylinder according to the present invention comprises a hollow cylinder tube, a head cover and a rod cover, which are attached to opposite ends of the above cylinder tube, a piston, which is slidably accommodated within the above cylinder tube, a piston rod, of which base end is slidably coupled with the above piston and of which front end passes through the above rod cover to be elongated to the outside of the cylinder tube, a stopper rod, of which base end is attached to the above head cover so that the location thereof can be adjusted and of which front end is elongated toward within the cylinder tube and passing through a central hole of the above piston and being fitted within the hollow portion of the piston rod and a stopper portion, which is attached to a front end of the above stopper rod and is engaged from the inside of the stopper rod to an engaging portion around of the central hole of the above piston at a forwarding stroke end of the above piston.

According to a specific embodiment of the present invention, the above stopper rod is attached to the head cover so that the location thereof can be adjusted by screwing a thread portion formed at the base end of the above stopper rod into a thread hole of the head cover, a locking nut for fixing is attached to the portion, which sticks out from the above head cover of the above thread portion to the outside and an operation unit is formed to move backward and forward the stopper rod at the above stuck portion.

The above operation unit preferably comprises a hexagonal hole for hanging a spanner, which is formed on the end surface of the stopper rod.

According to the present invention, a damper for shock absorbing can be provided either between the above head cover and the above piston or between the above engaging portion of the above piston and the above stopper of the above stopper rod.

The fluid pressure cylinder according to the present invention having above described constitution is capable of adjusting the stroke S of the piston and the rod by adjusting the position of the stopper rod and changing a distance between the stopper and the head cover.

Further, by providing the above stopper rod within the cylinder tube, the length of the stuck out portion of the stopper rod at the head side can be shorten, so that the fluid pressure cylinder, which can adjust the stroke of the piston, is capable of being compact. On this account, the setting space can be small. Further, as in the above described conventional example, the stopper and the piston rod attached with the stopper do not stick out to the outside of the cylinder during operation of the fluid pressure cylinder. Therefore, the safety of the fluid pressure cylinder can be enhanced.

Since the stopper rod is attached to the outside of the cylinder so that the position of the stopper rod is capable of being adjusted, the stroke of the piston can be easily adjusted in the working space.

DETAILED DESCRIPTION

Figure 1:
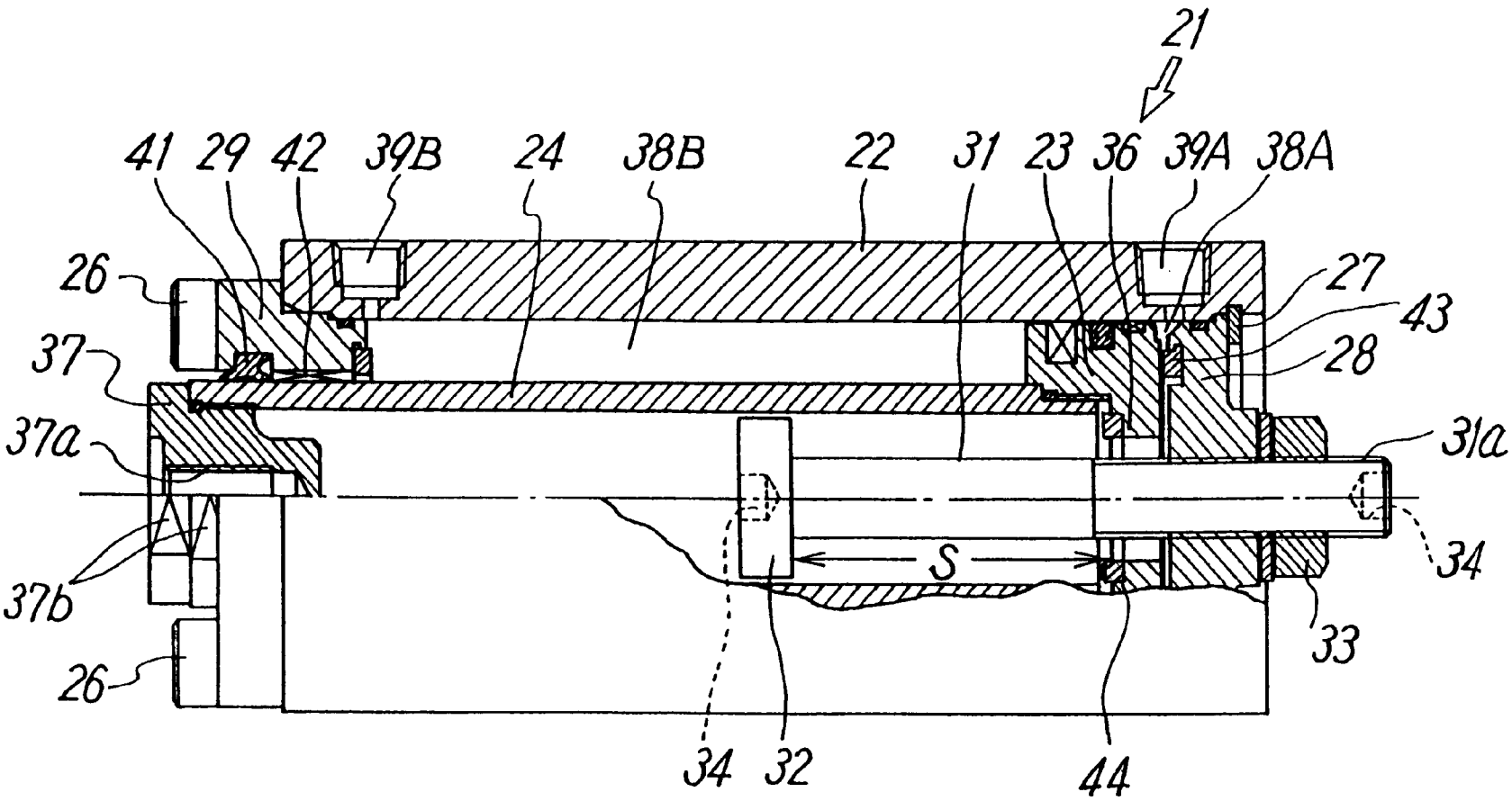
FIG. 1 is a longitudinal sectional view showing main parts according to an embodiment of the present invention.
Figure 3:
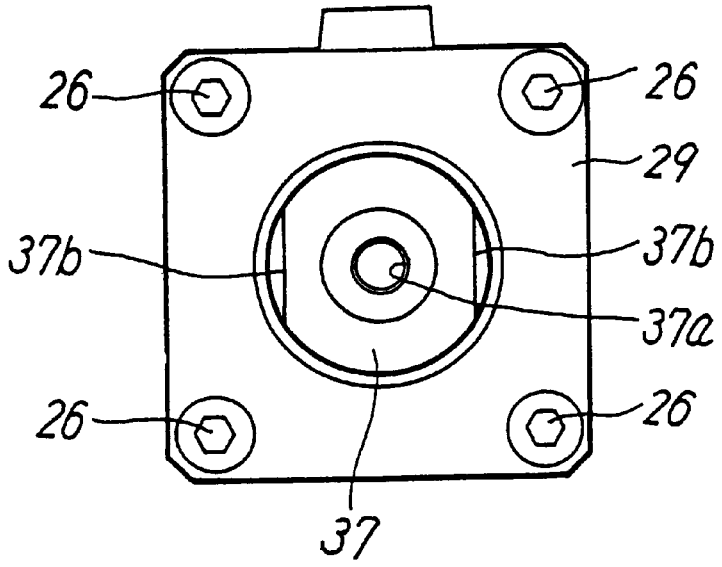
FIG. 3 is a lateral view according to an embodiment of the present invention.
Figure 4:
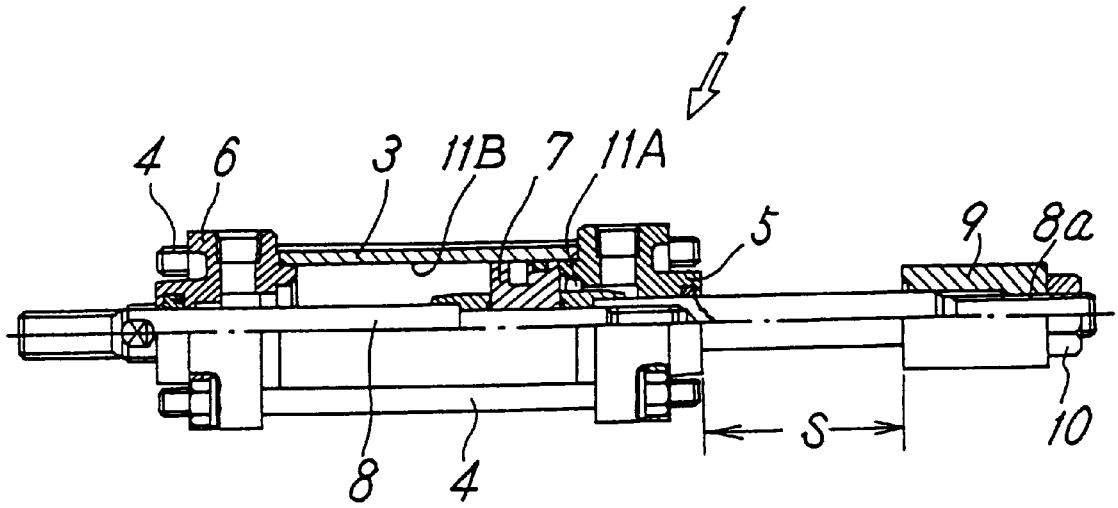
FIG. 4 PRIOR ART
FIG. 4 is a sectional view showing main parts according to a known fluid pressure cylinder.

FIGS. 1 and 3 show an example of a fluid pressure cylinder according to the present invention. This fluid pressure cylinder 21 comprises a cylinder tube 22, a piston 23, which moves slidably within this cylinder tube 22 which is airtight and a piston rod 24 in a hollow cylindrical shape, which is coupled to this piston 23.

The above described cylinder tube 22 comprises a head cover 28, which is fixed to the head side thereof by a stopping ring 27 and a rod cover 29, which is attached to the rod side by a plurality of bolts 26 (see FIG. 3).

A stopper rod 31 for adjusting the stroke S of the above piston 23 is screwed into a thread hole in a central part of the above head cover 28 by a male thread 31*a*, which is provided on a base end, so as to form the coaxial shape with the above piston. Therefore, the stopper rod 31 is capable of moving backward and forward in the moving direction of said piston 23. A locking nut 33 is screwed on the base end, which sticks out from the head cover 28 of the above male thread 31*a* to the outside via a washer 35 keeping airtight between the male thread 31*a* and the washer 35, so that the locking nut 33 allows the stopper rod 31 to be fixed on a predetermined position.

On the other hand, the front end of the above stopper rod 31 passes through the piston 23 and is fitted into the inside of the above piston rod 24. A stopper 32 in a disk shape, which is engaged from the inside of the stopper rod 31 to an engaging portion 36 of the piston 23, is provided on the front end of the above stopper rod 31. Further, on the opposite ends in the axial direction of the above stopper rod 31, a spanner hanging hole 34 for hanging a hexagonal spanner (not illustrated) is formed.

The above piston 23 has the above engaging portion 36 around a central hole thereof. The base end of the above piston rod 24 is screwed into the above piston 23 in airtight manner and the front end of the above piston rod 24 passes through the rod cover 29 slidably to be elongated to the outside of the cylinder tube 22. A sealing member 37 is screwed into the front end of this piston rod 24 to close a hollowing portion 24*a*. This sealing member 37 is provided with a female thread at the central portion of the outer end surface thereof, so that an attaching portion 37*a* for attaching workpieces or the like (not illustrated) is formed and a spanner hanger 37*b* composing of flat surfaces is mounted on the outer peripheral surface of this sealing member 37 and the outer peripheral surface of the piston rod 24, respectively.

The inside of the above cylinder tube 22 is partitioned into a head side pressure chamber 38A and a rod side pressure chamber 38B in airtight by the above piston 23. In the vicinity of the opposite ends of the cylinder tube 22 in the axial direction, a head side port 39A and a rod side port 39B are opened to supply a compressed air to these pressure chambers 38A and 38B.

Reference numerals 41 and 42 in FIG. 1 designate a rod packing, which is attached to the rod cover 29, for sealing the outer peripheral surface of the piston rod 24 in airtight, a bearing and reference numerals 43 designates a damper attached to the head cover 28. Further, also on the abutting surface of the stopper 32 at the front end of the above stopper rod 31 and the engaging portion 36 of the piston 23, the damper 44 may be attached according to need.

FIG. 1 shows a state that a compressed air is supplied to the rod side pressure chamber 38B and the air in the head side pressure chamber 38A is discharged to the outside. In FIG. 1, the piston 23 and the piston rod 24 are located in a terminal end location of the backward stroke.

Figure 2:
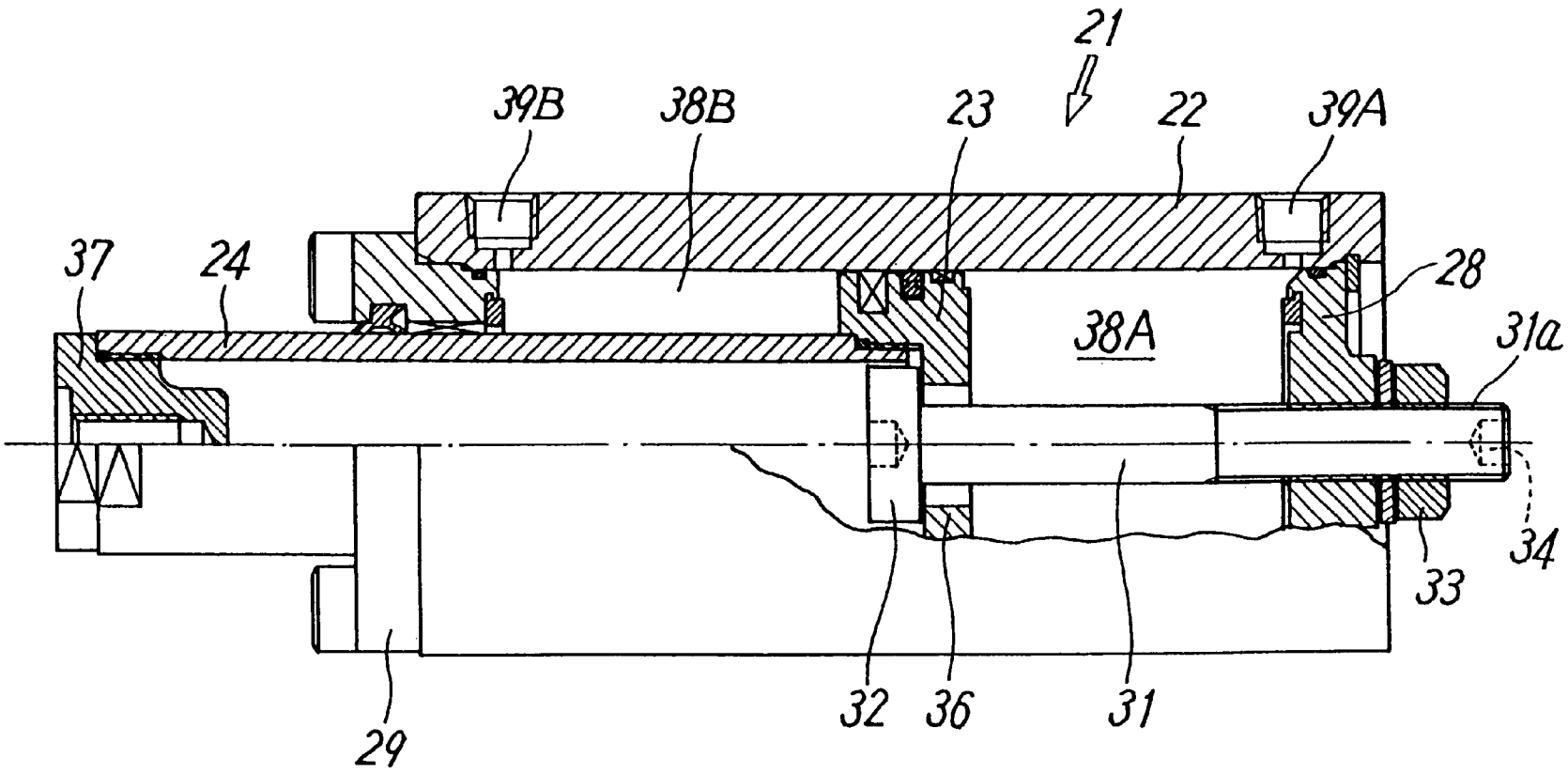
FIG. 2 is a sectional view showing an operational condition according to an embodiment of the present invention.

A switching valve (not illustrated) supplies the compressed air from the port 39A to the head side pressure chamber 38A and discharges the air in the rod side pressure chamber 38B from the port 39B to the outside. As a result, as shown in FIG. 2, the piston 23 and the piston rod 24 move forward to stick out from the cylinder tube 22 and the engaging portion 36 of the piston 23 is engaged to the stopper portion 32, so that the forwarding stroke is completed.

Turning over the supplying and discharging relation between the head side pressure chamber 38A and the rod side pressure chamber 38B, the piston 23 and the piston rod 24 move backward as shown in FIG. 1. The piston 23 is stopped in shock absorbing by damper 43, which is attached to the head cover 28.

According to the above embodiment, the locking nut 33 is fastened, the hexagonal spanner (not illustrated) is hanged in the spanner hanging hole 34, which sticks out to the outside of the cylinder tube 22 and the stopper rod 31 is rotated. As a result, said stopper rod 31 moves backward and forward in the axial direction of the cylinder tube 22, so that a distance between the stopper portion 32 and the engaging portion 36 of the piston 23, i.e., the stroke S of the piston 23 is capable of being adjusted and the location of the stopper rod 31 can be fixed by the locking nut 33 after adjusting the stroke S.

The adjustment of the stroke of this piston 23 can be carried out by the workers in the working space at the outside of the cylinder tube 22. Accordingly, the adjustment operation can be easily performed.

According to the above embodiment, the stopper rod 31, which is screwed into the head cover 28, is moved backward and forward in the moving direction of the piston 23, so that the stroke of the piston 23 can be adjusted. Therefore, the stroke S of the piston 23 comprises a desirable stroke such that the kinds of the workpiece (not illustrated) attached to the rod 24 corresponds to the working content or the like.

Further, the stopper portion 32 for adjusting the stroke of the piston 23 is located within the cylinder tube 22, so that the length in the axial direction of the fluid pressure cylinder 21 is shortened and the fluid pressure cylinder 21 is capable of being compact. Accordingly, the setting space of the fluid pressure cylinder 21 can be small. Furthermore, as shown in the above conventional example, the stopper and the piston rod provided with this stopper do not stick out to the outside of the cylinder tube upon operation of the fluid pressure cylinder, so that the safety of the fluid pressure cylinder can be enhanced.

Further, supplying the compressed air to the head side pressure chamber 38A, this air acts upon the sealing member 37 through between the engaging portion 36 of the piston 23 and the stopper rod 31 and the hollow portion 24*a* of the rod 24 and the stopper portion 32. Therefore, in the cylinder in which the stopper rod 31 facing the rod side is attached to the head cover 28, the driving force of the piston 23 is identical with that in the cylinder in which the stopper rod 31 is not provided thereto. Accordingly, the stopper rod 31 does not lower the driving force of the piston 23.

What is claimed is:

1. A fluid pressure cylinder in which a stroke a piston is adjustable, comprising:

a hollow cylinder tube;

a pair of ports disposed on the hollow cylinder tube;

a head cover and a rod cover, which are attached to opposite ends of said hollow cylinder tube;

a head side pressure chamber and a rod side pressure chamber, each connected to one of the pair of ports;

a piston, which is slidably accommodated within said cylinder tube;

a piston rod including a hollow shape, a top end which is sealed and a base end which is connected to the head side pressure chamber through a central hole of the piston, the base end is slidably coupled with said piston and of which front end passes through said rod cover to be elongated to the outside of said cylinder tube;

a stopper rod including a base end attached to said head cover so that the location thereof can be adjusted and a front end elongated toward and within said cylinder tube and passing through the central hole of said piston and being fitted within the hollow portion of said piston rod;

a stopper portion, which is attached to a front end of said stopper rod and which is engaged from the inside of the piston rod to an engaging portion around said central hole of said piston at a forwarding stroke end of said piston; and an engaging portion formed inside the piston, the stopper portion engaging with the engaging portion;

wherein the stopper rod and the stopper portion are inserted into the central hole disposed between the piston and the piston rod so that a gap is formed inside.

2. A fluid pressure cylinder according to claim 1, wherein said stopper rod is attached to said head cover so that the location thereof can be adjusted by screwing a thread portion formed at the base end of said stopper rod into a thread hole of said head cover, a locking nut configured to fix is attached to the portion, which sticks out from said head cover of said thread portion to the outside, and an operation unit is formed to move backward and forward said stopper rod at a predetermined position.

3. A fluid pressure cylinder according to claim 2, wherein said operation unit comprises a hexagonal hole for hanging a spanner, which is formed on the end surface of said stopper rod.

4. A fluid pressure cylinder according to claim 1, wherein a damper for shock absorbing is provided in at least one position of between said head cover and said piston and between said engaging portion of said piston and said stopper of said stopper rod.

5. A fluid pressure cylinder in which a stroke a piston is adjustable, comprising:

a hollow cylinder tube;

a head cover and a rod cover, which are attached to opposite ends of said hollow cylinder tube;

a piston which is slidably accommodated within said hollow cylinder tube;

a piston rod including a base end which is slidably coupled with said piston and front end which passes through said rod cover to be elongated to the outside of said hollow cylinder tube;

a stopper rod including a base end is attached to said head cover so that the location thereof can be adjusted and a front end elongated toward and within said cylinder tube and passing through a central hole of said piston and being fitted within the hollow portion of said piston rod; and a stopper portion, which is attached to a front end of said stopper rod and which is engaged from the inside of the piston rod to an engaging portion around said central hole of said piston at a forwarding stroke end of said piston;

wherein said stopper rod is attached to said head cover so that the location thereof can be adjusted by screwing a thread portion formed at the base end of said stopper rod into a thread hole of said head cover, a locking nut for fixing is attached to the portion, which sticks out from said head cover of said thread portion to the outside and an operation unit is formed to move backward and forward said stopper rod at a predetermined portion; and wherein said operation unit comprises a hexagonal hole for hanging a spanner, which is formed on the end surface of said stopper rod.

6. A fluid pressure cylinder according to claim 5, wherein a damper for shock absorbing is provided at least one position of at least one of between said head cover and said piston and between said engaging portion of said piston and said stopper of said stopper rod.

* * * * *